US006318504B1

(12) United States Patent
De Angelis

(10) Patent No.: US 6,318,504 B1
(45) Date of Patent: Nov. 20, 2001

(54) SYNTHETIC FIBER ROPE

(75) Inventor: Claudio De Angelis, Luzern (CH)

(73) Assignee: Inventio AG, Hergiswil NW (CH)

( * ) Notice: Subject to any disclaimer, the term of this patent is extended or adjusted under 35 U.S.C. 154(b) by 0 days.

(21) Appl. No.: 09/422,527

(22) Filed: Oct. 21, 1999

(30) Foreign Application Priority Data

Oct. 23, 1998 (EP) ..... 98811068

(51) Int. Cl.[7] ..... B66B 11/08; D02G 3/36

(52) U.S. Cl. ..... 187/254; 187/411; 187/251; 57/204; 57/235; 57/230

(58) Field of Search ..... 57/230, 235, 204, 57/217, 218; 187/251, 266, 254, 41, 414; 385/108, 113

(56) References Cited

U.S. PATENT DOCUMENTS

| | | | | |
|---|---|---|---|---|
| 3,318,082 | * | 5/1967 | Riggs | 57/217 |
| 4,202,164 | * | 5/1980 | Simpson et al. | 57/232 |
| 4,498,282 | * | 2/1985 | Graetz | 57/218 |
| 4,534,162 | * | 8/1985 | Riggs et al. | 57/217 |
| 4,606,604 | * | 8/1986 | Soodak | 385/113 |
| 4,667,462 | * | 5/1987 | Smyth | 57/217 |
| 4,696,542 | * | 9/1987 | Thompson | 385/108 |
| 4,722,589 | * | 2/1988 | Priaroggia | 385/113 |
| 4,725,121 | * | 2/1988 | Priaroggia | 385/113 |
| 4,887,422 | * | 12/1989 | Klees et al. | 57/218 X |
| 5,526,552 | | 6/1996 | De Angelis . | |
| 5,566,786 | | 10/1996 | De Angelis . | |
| 5,834,942 | * | 11/1998 | De Angelis | 187/226 |

FOREIGN PATENT DOCUMENTS 644 413 7/1984 (CH) .

* cited by examiner

*Primary Examiner*—Eileen D. Lillis
*Assistant Examiner*—Thuy V Tran
(74) *Attorney, Agent, or Firm*—MacMillan, Sobanski & Todd, LLC

(57) ABSTRACT

A synthetic fiber rope having load-bearing aramide fiber strands laid together in parallel in concentric layers of strands and an intersheath with sheath surfaces adapted to the external contours of the adjacent layers of strands. By positively bonding the inner and outer layers of strands a higher torsional rigidity is achieved as well as a rope structure of the stranded rope which is less susceptible to twisting. Furthermore, the elastic intersheath between the layers of stands serves to protect the strands against abrasion and assists in transmitting torque within the rope over a large area.

7 Claims, 1 Drawing Sheet

SYNTHETIC FIBER ROPE

BACKGROUND OF THE INVENTION

The present invention relates to a synthetic fiber rope, preferably of aromatic polyamide material.

Especially in materials handling technology, for example on elevators, in crane construction, and in open-pit mining, etc., ropes are an important element of machinery and subject to heavy use. An especially complex aspect is the loading of driven or over pulleys deflected ropes, for example as they are used in elevator construction.

Specifically, on elevator installations the lengths of rope needed are large, and considerations of energy lead to the demand for smallest possible masses. High-tensile synthetic fiber ropes, for example of aromatic polyamides or aramides with highly oriented molecule chains, fulfil these requirements better than conventional steel ropes.

Specifically, ropes constructed of aramide fibers have a substantially higher lifting capacity than conventional steel ropes of the same cross section, and only between one fifth and one sixth of the specific gravity. However, the atomic structure of aramide fiber causes it to have a low ultimate elongation and a low shear strength.

Such an aramide fiber rope with parallel lay is known, for example, from European patent document EP 0 672 781 Al. There, between the outermost and inner layers of strands there is an intersheath which prevents contact between the strands of different layers and thereby reduces the wear due to their rubbing against each other. The aramide rope described so far has satisfactory values of service life, resistance to abrasion, and fatigue strength under reversed bending stresses. However, when loaded under tension the twisted stranded synthetic fiber rope has a tendency to rotate about its longitudinal axis and/or untwine. The undesirable untwining of the stranded rope can lead to an unevenly distributed loading of the strands of different strand length over the cross section of the rope and thereby to a reduction in the breaking load of the rope or even to failure of the rope.

SUMMARY OF THE INVENTION

An objective of the present invention is to avoid the disadvantages of the known synthetic fiber rope and to specify a permanently dependable twisted synthetic fiber rope.

The advantages resulting from the present invention relate to the fact that the intersheath, by having sheath surfaces adapted to the contours of adjacent layers of strands, provides a larger area of contact with the strands and thereby also completely bridges the interstices between the strands of the layers of strands adjacent to it. The tight bond between inner and outer layers of strands results in a higher torsional rigidity of the stranded rope. This prevents a loaded rope with contoured intersheath according to the invention from twisting irrespective of the type of torque acting on it. With the invention there is therefore a greater supporting and/or load-bearing area of sheath available even when the rope is in the loaded state. This in turn results in a homogenized transfer of torque over the entire circumferential area of the sheath to the interior of the rope. As a result, the constrictive force of the covering layer of strands no longer acts mainly as a transverse force on the highest points of individual strands, but is spread widely, i.e. with reduced pressure, over the entire circumferential surface of the sheath of the adjacent layers of strands.

With appropriately selected elasticity, the intersheath can absorb differing longitudinal movements of adjacent strands without the strands moving relative to the intersheath, from which advantages are derived in relation to the flexibility of the rope and its behavior under reversed bending.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
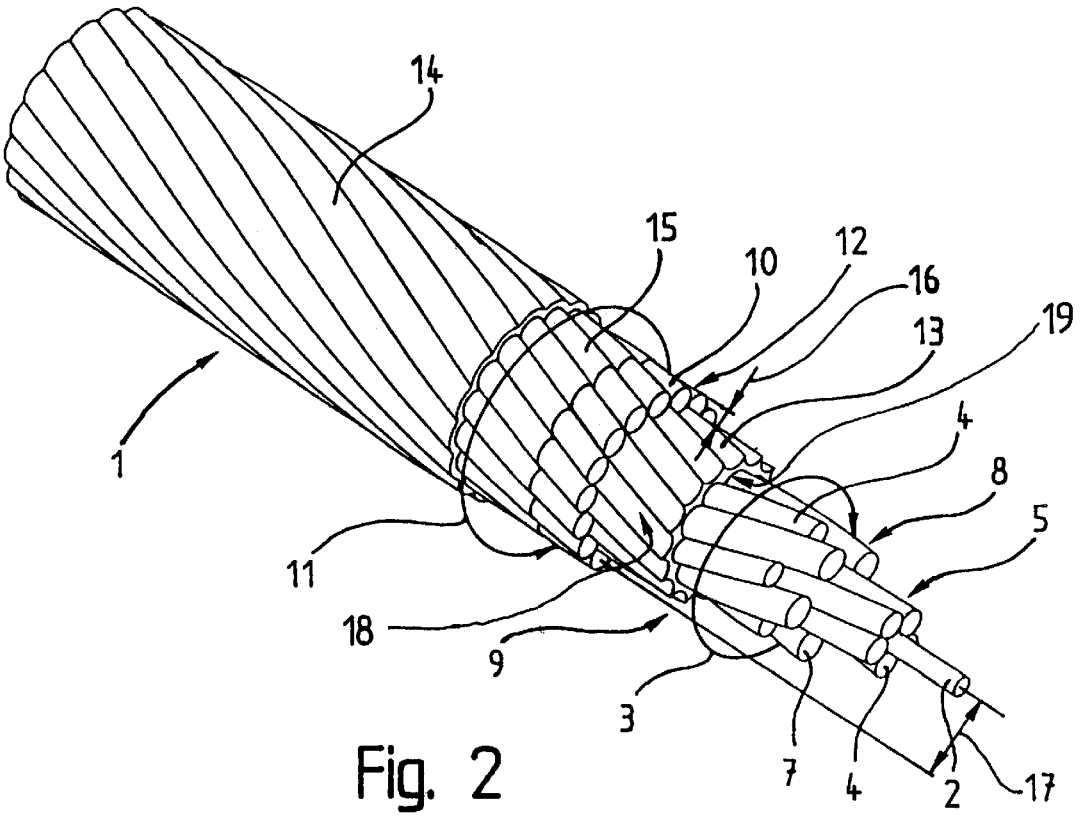
FIG. 1 is a perspective view of a traction rope with an intersheath in accordance with the present invention.

FIG. 1 shows a rope 1 such as is used as a means of suspension and hoisting in elevator installations, for example by being driven via a rope sheave or rope drum. In such installations the car sling of the car, which is moved in an elevator hoistway, and a counterweight are connected together by a rope. To raise and lower the car and the counterweight, the rope runs over a traction sheave which is driven by a drive motor. The drive torque is transferred by friction to the section of the rope which at any moment is lying in the angle of wrap. At this point the rope is subjected to high transverse forces. A typical elevator installation having a car and a counterweight supported by a rope is shown in the U.S. Pat. No. 5,566,786 which is incorporated herein by reference.

The rope 1 is constructed of a core strand 2 around which in a first direction of lay 3 five identical strands 4 of a first layer of strands 5 are laid helically, and on them ten strands 4 and 7 of a second layer of strands 8 laid in parallel lay with a balanced ratio between the direction of twist of the strands and the rope lay.

Figure 2:
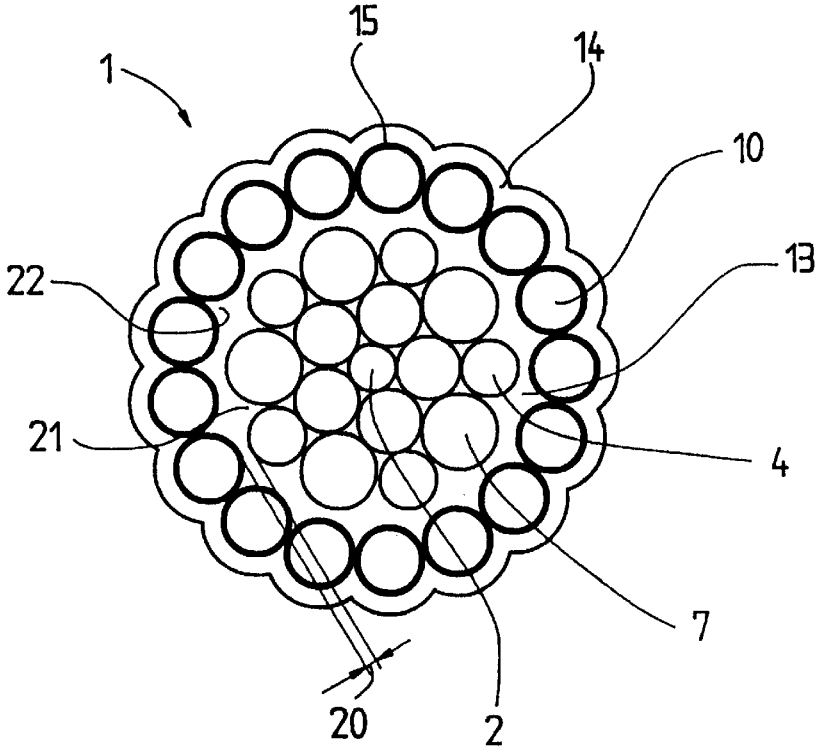
FIG. 2 is a cross-sectional view of the traction rope shown in the FIG. 1.

The second layer of strands 8 comprises an alternating arrangement of two types of five identical strands 4 and 7 each. The cross-section through the rope 1 illustrated in FIG. 2 shows five further strands 7 with a larger diameter which lie helically in the hollows of the first layer of strands 5 which supports them, while five strands 4 with the smaller diameter of the strands 4 of the first layer of strands 5 lie on the highest points of the first layer of strands 5 that supports them and thereby fill the gaps between two adjacent strands 7 having a greater diameter. In this way, a doubly parallel laid rope core 9 receives the second layer of strands 8 with an almost circular external profile, which in combination with an intersheath 13 affords advantages which are subsequently described below. When the rope 1 is loaded longitudinally, the parallel lay of the rope core 9 creates a torque in the opposite direction to the first direction of lay 3. On the rope core 9, seventeen strands 10 are laid in hawser manner in a second direction of lay 11 opposite to the first direction of lay 3 to form a covering layer of strands 12. In the illustrated embodiment, the ratio of the length of lay of the strands 10 lying on the outside of the rope 1 to the strands 4 and 7 of the inner layers of strands 5 and 8 is approximately 1.6. Under load, the lay of the covering layer of strands 12 develops a torque in the opposite direction to the second direction of lay 11.

Between the covering layer of strands 12 laid in the second direction of lay 11 and the strands 4 and 7 of the second layer of strands 8 is the intersheath 13. The intersheath 13 consists of an elastically deformable material, such as polyurethane or polyester elastomers, and is molded or extruded onto the stranded rope core 9. During this process the freshly applied intersheath 13 is plastically deformed, lying tight against contours of the circumferential sheath of the layers of strands 8 and 12, filling all the interstices, and forming grooves 18 and 19 impressed on it by the adjacent layers of strands 12 and 8 respectively. Thus, each of the grooves 18 and 19 receives an associated one of the strands of the layers 12 and 8 respectively.

The contoured intersheath 13 takes the form of a tube enveloping the second layer of strands 8 and thereby prevents contact of the strands 4 and 7 with the strands 10. In this way it prevents wear of the strands 4, 7 and 10 being caused by the strands 4, 7 and 10 rubbing against each other as a result of moving relative to each other when the rope 1 runs over the traction sheave, such relative movement taking place to compensate differences in tensile stress which occur, for example, when the direction of the rope is reversed under load on the traction sheave.

By virtue of friction and its shape, the intersheath 13 also transmits the torque which is developed in the covering layer of strands 12 when the rope 1 is under load to the second layer of strands 8, and thereby to the rope core 9, whose parallel lay develops a torque in the opposite direction to the direction of lay 3.

At the same time, the frictional resistance $\mu>0.15$ between the strands 4, 7 and 10 and the intersheath 13 is so chosen that practically no relative movement occurs between the strands and the intersheath, but so that the intersheath 13 follows the compensating movements by deforming elastically. The elasticity of the intersheath 13 is greater than that of the strand impregnation and that of the supporting strand material and thereby prevents their becoming prematurely damaged. On the other hand, the overall extension of the material selected for the intersheath 13 is in all cases greater than the maximum movement that occurs of the strands 4, 7 and 10 relative to each other.

A thickness 20 of the intersheath 13 can be used to set in a controlled manner a radial distance 17 of the covering layer of strands 12 from the center of rotation of the rope 1 and thereby to neutralize the torque ratio between the torque of the covering layer of strands 12 and of the parallel laid rope core 9 which act in opposite directions to each other in the loaded rope 1. The thickness 20 selected for the intersheath 13 must be increased with increasing diameter of the strands 10 and/or the strands 4 and 7. In all cases, the thickness 20 of the intersheath 13 must be given such a dimension as to ensure that under load, when interstices 21 and 22 between the strands are completely filled, there is a remaining sheath thickness of 0.1 mm between strands 4, 7 and 10 of the adjacent layers of strands 8 and 12. The plastically deformed intersheath 13 causes a homogenized transmission of torque over the entire circumferential surface of the sheath. The volume of the interstices between the strands can be minimized by an alternating arrangement of strands of large diameter 7 and strands 4 of smaller diameter in the second layer of strands 8.

As well as being used purely as a suspension rope, the rope can be used in a wide range of equipment for handling materials, examples being elevators, hoisting gear in mines, building cranes, indoor cranes, ship's cranes, aerial cableways, and ski lifts, as well as a means of traction on escalators. The drive can be applied by friction on traction sheaves or Koepe sheaves, or by the rope being wound on rotating rope drums. A hauling rope is to be understood as a moving, driven rope, which is sometimes also referred to as a traction or suspension rope.

A rope sheath 14 is provided as a protective sheath for the aramide fiber strands. The rope sheath 14 consists of synthetic material, preferably polyurethane, and ensures that the coefficient of friction on the traction sheave is of the required value $\mu$. Furthermore, the abrasion resistance of the sheath of synthetic material is also a rigorous requirement so that no damage occurs as the elevator rope runs over the traction sheave. The rope sheath 14 bonds so well with the covering layer of strands 12 that as the traction rope I runs over the traction sheave with the transverse and pressure forces which arise between them no relative movement occurs. Apart from the rope sheath 14 which encloses the entire covering layer of strands 12, each individual strand 10 can in addition be provided with a separate, seamless sheath 15. The remaining structure of the traction rope 1 remains unchanged, however.

Beside in elevators and aerial cableways, the rope according to the present invention is applicable in various installations for material handling, for example for elevators, hoisting, cranes for house construction, factories or ships, ski lifts or for escalators. The rope can be driven by a traction device such as a traction sheave or a turning drum on which the rope is coiled up.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A synthetic fiber rope comprising: at least an inner layer and an outer layer of load-bearing synthetic fiber strands laid together, said layers being concentric and radially separated from one another forming an interlayer space, and a tubular shaped intersheath positioned in said interlayer space between said layers and enveloping said inner layer, said intersheath being elastically deformable and having a plurality of grooves formed therein, each one of said grooves being contoured to receive an associated one of said fiber strands of an adjacent one of said layers.

2. The synthetic fiber rope according to claim 1 wherein a coefficient of friction "$\mu$" between said fiber strands and said intersheath is greater than 0.15.

3. The synthetic fiber rope according to claim 1 wherein an overall extension of said intersheath is greater than a maximum movement of said fiber strands relative to each other.

4. The synthetic fiber rope according to claim 1 wherein said grooves extend helically on an outside surface and an inside surface of said intersheath, a direction of the helix on the outside surface being opposite to a direction of the helix on the inside surface of the sheath.

5. The synthetic fiber rope according to claim 1 wherein said intersheath has a thickness of approximately 0.1 mm at a thinnest point under load.

6. An elevator installation comprising:

an elevator car;

a traction means being one of a traction sheave and a rope drum; and a synthetic fiber rope in friction contact with said traction means and supporting said elevator car, said rope having at least an inner layer and an outer layer of load-bearing synthetic fiber strands laid together, said layers being concentric and radially separated from one another forming an interlayer space, and a tubular shaped intersheath positioned in said interlayer space between said layers and enveloping said inner layer, said intersheath being elastically deformable and having a plurality of grooves formed therein, each one of said grooves being contoured to receive an associated one of said fiber strands of an adjacent one of said layers.

7. A synthetic fiber rope comprising:

an inner layer of load-bearing synthetic fiber strands laid together;

an outer layer of load-bearing synthetic fiber strands laid together, said outer layer being concentric and radially separated from one another to form an interlayer space; and a tubular-shaped intersheath positioned in said interlayer space between said layers and enveloping said inner layer, said intersheath having a plurality of grooves formed therein, each one of said grooves being contoured to receive an associated one of said fiber strands of an adjacent one of said inner and outer layers, and said intersheath being comprised of an elastically deformable material providing a frictional resistance between said intersheath and said inner and outer layers substantially preventing relative movement therebetween.

* * * * *